US007546802B2

(12) United States Patent
Kasper et al.

(10) Patent No.: US 7,546,802 B2
(45) Date of Patent: Jun. 16, 2009

(54) FLUID SUPPLY DEVICE FOR A PRINTING MACHINE

(75) Inventors: Kent Dirksen Kasper, Dover, NH (US); Stephen Arthur Austin, Sumerset, CT (US)

(73) Assignee: Goss International Americas, Inc., Durham, NH (US)

( * ) Notice: Subject to any disclaimer, the term of this patent is extended or adjusted under 35 U.S.C. 154(b) by 533 days.

(21) Appl. No.: 10/628,652

(22) Filed: Jul. 28, 2003

(65) Prior Publication Data

US 2005/0022685 A1 Feb. 3, 2005

(51) Int. Cl.
*B41F 31/00* (2006.01)

(52) U.S. Cl. ..... 101/350.1; 101/157; 101/364; 118/261

(58) Field of Classification Search ..... 101/169, 101/157, 350.1, 350.5, 350.6, 364–367, 483; 15/256.5; 118/261, 212, 281, 410
See application file for complete search history.

(56) References Cited

U.S. PATENT DOCUMENTS

| | | | | | |
|---|---|---|---|---|---|
| 1,801,935 | A * | 4/1931 | Pfister | 101/365 |
| 2,232,274 | A | 2/1941 | Robbins | 101/384 |
| 3,037,451 | A | 6/1962 | Davis | 101/350 |
| 3,273,535 | A * | 9/1966 | Krikorian | 101/364 |
| 3,294,060 | A * | 12/1966 | McIntyre et al. | 101/169 |
| 3,585,932 | A * | 6/1971 | Granger | 101/351.7 |
| 3,664,261 | A * | 5/1972 | Dahlgren | 101/177 |
| 3,709,147 | A | 1/1973 | Granger | 101/351 |
| 4,007,682 | A | 2/1977 | Gundlach | 101/348 |
| 4,050,380 | A * | 9/1977 | Pfizenmaier et al. | 101/365 |
| 4,184,429 | A | 1/1980 | Widmer | 101/169 |
| 4,392,431 | A * | 7/1983 | Wieland | 101/365 |
| 4,615,295 | A | 10/1986 | Wittkopf | 118/261 |
| 4,699,055 | A | 10/1987 | Jeschke | 101/350 |
| 4,924,802 | A * | 5/1990 | Knop | 118/410 |
| 5,003,875 | A | 4/1991 | Shriver | 101/350 |
| 5,044,277 | A * | 9/1991 | John | 101/367 |
| 5,536,312 | A * | 7/1996 | Madrzak et al. | 15/256.5 |
| 5,582,645 | A * | 12/1996 | Trest et al. | 118/410 |
| 5,826,509 | A * | 10/1998 | Deneka | 101/366 |
| 5,862,756 | A * | 1/1999 | Gorter | 101/364 |
| 6,393,983 | B1 * | 5/2002 | Iijima et al. | 101/367 |
| 6,450,097 | B1 * | 9/2002 | Kistler et al. | 101/483 |

FOREIGN PATENT DOCUMENTS

| | | | |
|---|---|---|---|
| JP | 59-169897 | * | 9/1984 |

* cited by examiner

*Primary Examiner*—Ren Yan
(74) *Attorney, Agent, or Firm*—Davidson, Davidson & Kappel, LLC

(57) ABSTRACT

A fluid delivery device for a printing machine includes a rotating roller having a roller surface with a roller radius of curvature, the roller surface carrying a fluid film, and a metering element having an edge for splitting the fluid film and a first concave surface facing the roller surface. The metering element is movable with respect to the roller surface.

15 Claims, 2 Drawing Sheets

FLUID SUPPLY DEVICE FOR A PRINTING MACHINE

BACKGROUND INFORMATION

The present invention relates to printing machines; and more particularly for a fluid supply device such as an ink metering device for a printing machine.

U.S. Pat. Nos. 3,037,451, 4,007,682, 4,184,429 and 4,669,055 disclose devices for apportioning ink using doctor blades.

In U.S. Pat. Nos. 4,007,682 and 4,184,429, the doctor blades have edges which are wedge-shaped or bevelled. In U.S. Pat. No. 4,007,682, the blade with the wedge-shaped edge is flexible and the blade floats or planes over the ink film.

BRIEF SUMMARY OF THE INVENTION

An object of the present invention is to improve delivery and/or metering of fluids to a roller.

The present invention provides a fluid delivery device for a printing machine comprising:

a rotating roller having a roller surface with a roller radius of curvature, the roller surface carrying a fluid film; and a metering element having an edge for splitting the fluid film and a first concave surface facing the roller surface;

the metering element being movable with respect to the roller surface so as to define a thickness of the fluid film downstream from the metering element.

The first concave surface provides for better flow characteristics and reduces pressures on the metering element.

Preferably, the metering element has a second concave surface opposite the first concave surface. The two concave surfaces permit pressures to minimized even further.

The first concave surface preferably has a radius of curvature similar to that of the roller radius of curvature.

The first concave surface may, for example, correspond to an arc of 5 degrees or more of the roller surface.

Preferably the metering element is rigid, and has a first bottom surface. The bottom surface is preferably horizontal to permit fluid from the second concave surface to return to a supply container. The metering element may be made of metal, such as stainless steel.

The fluid preferably is ink, but may also be a dampening solution for example.

The present invention also provides a method for metering fluid in a printing press having an operating speed comprising the steps of:

supplying fluid to a supply container;

rotating a roller so as to form a film of the fluid on a surface of the roller; and splitting the film using a metering element, the metering element having a concave surface facing the surface of the roller.

Preferably, the roller has a surface speed similar to that of a plate or image cylinder of the printing press. The concave surfaced ink key advantageously permits roller speeds similar to that of the printing press.

BRIEF DESCRIPTION OF THE DRAWING

The present invention will be described with respect to a preferred embodiment in which.

DETAILED DESCRIPTION

Figure 1:
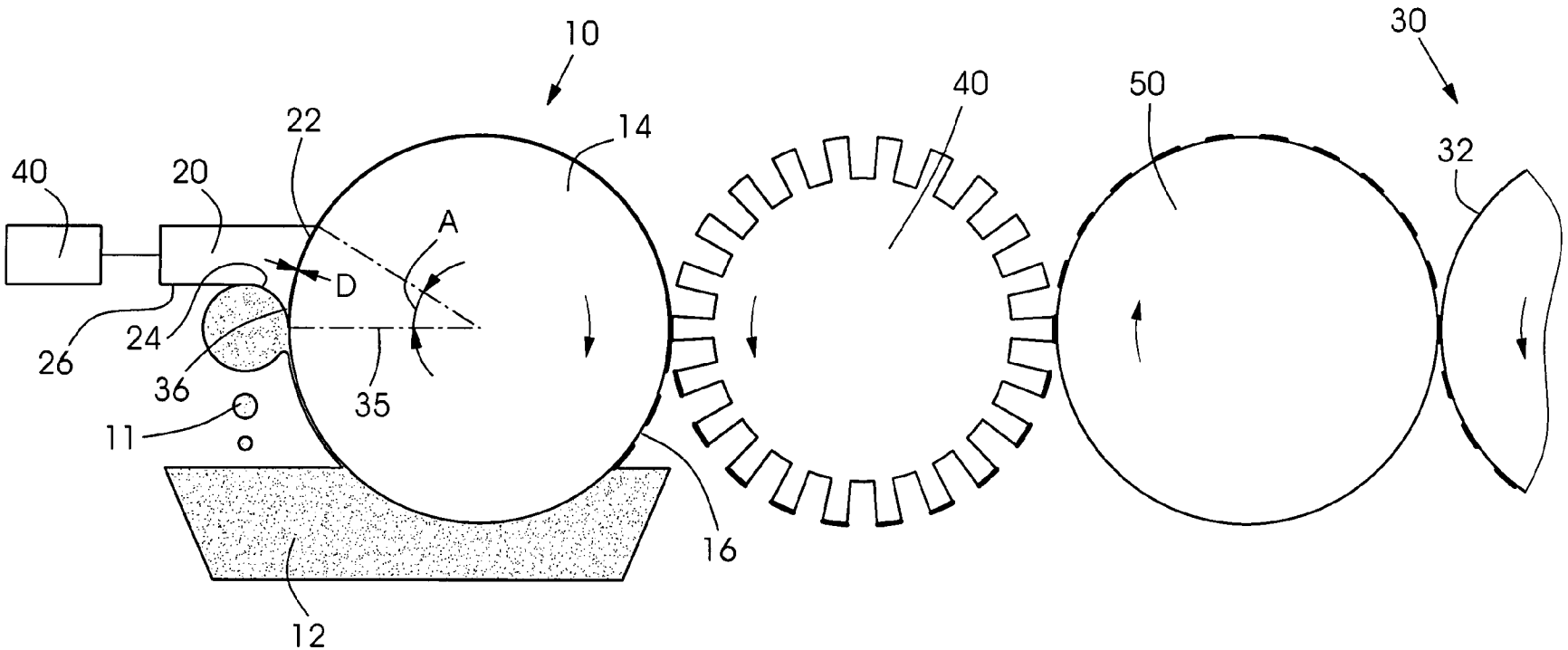
FIG. 1 shows a perspective view of an embodiment of the fluid supply device of the present invention.

FIG. 1 shows a perspective schematic view of an ink supply device 10 according to the present invention for use in a printing press 30 having a plate or image cylinder 32. Ink supply device 10 includes an ink supply container 12, a fountain roller 14 for removing ink from the supply container 12, and at least one metering element 20. Fountain roller 14 has an outer surface 16.

Metering element 20 has a first concave surface 22 facing outer surface 16, and may have a second concave surface 24 facing away from the first concave surface 22. The first and second concave surfaces meet at an edge 36, shown in more detail in FIG. 2. The second concave surface 24 can terminate away from edge 36 in a flat bottom surface facing container 12, so that ink returns to container 12, for example through gravity in the form of drops 11. The second concave surface 24 however could also be flat or of other shape.

Metering element 20 is movable with respect to the fountain roller 14 via a controller 40, which may also be the controller for the press 30 so as to set a distance D between outer surface 16 and first concave surface 22. First concave surface 22 may have a radius of curvature similar to that of the fountain roller, which reduces the pressure forces generated at the metering element 20. The desired radius of curvature of surface 22 depends on the fountain roller radius of curvature and on the most common operating distance of the distance D. The distance D is sought to be as constant as possible over the angle A where the surface 22 is facing surface 16, so as to minimize pressure changes caused by the fluid. As an example, for certain devices, the radius of curvature of the fountain roller may be 2.500 inches (6.35 centimeters), and the radius of curvature of the concave surface 2.504 inches (6.36 centimeters). Preferably, the radius of curvatures are within 10% of each other. The motion of metering element 20 preferably is such that edge 36 moves along a path of a radial line 35 drawn from the center of roller 14.

The first concave surface may, for example, correspond to an arc A of 5 degrees or more of the roller surface.

Once the ink film on roller 14 passes metering element 20, the ink film may be transferred to a reducer roll 40, which can transfer a small portion, for example 1/100, of the metered ink on roller 14 to the ink train 50 (represented here by a single roller). The ink is then passed to the plate or image cylinder 32 of the printing press 30.

Figure 2:
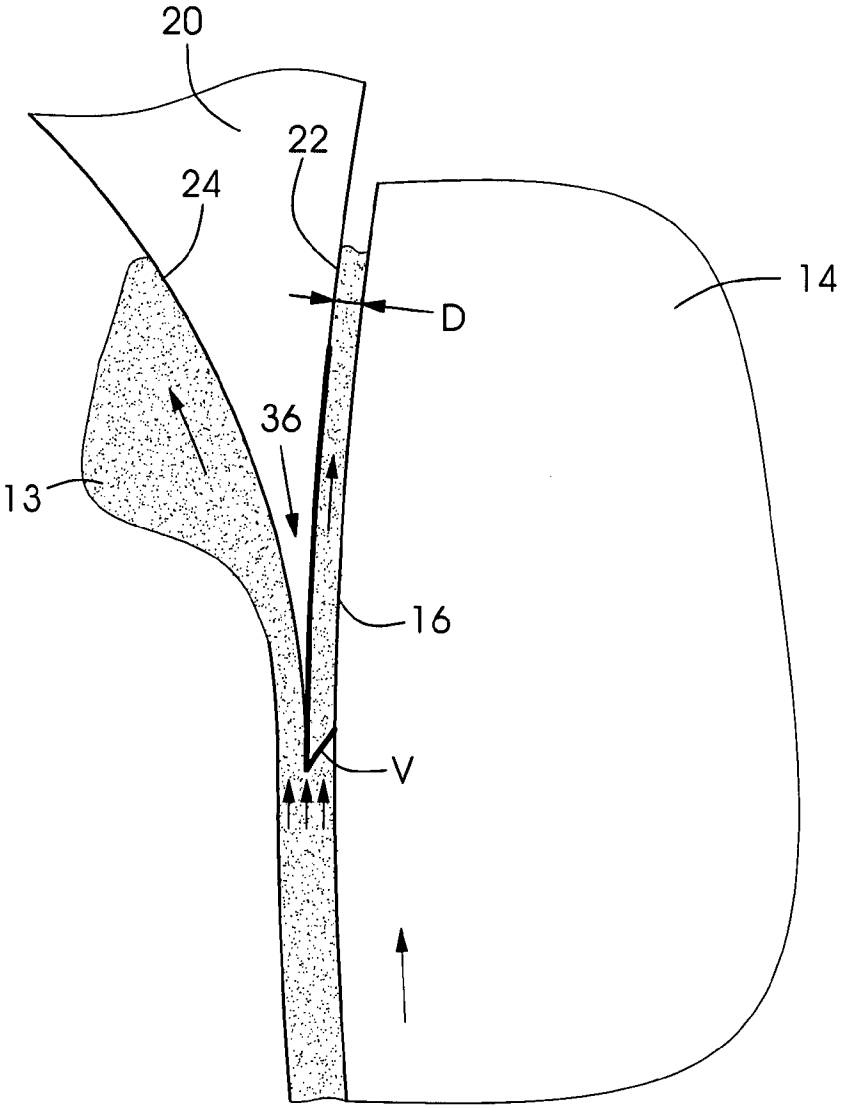
FIG. 2 shows in more detail the fluid separation caused by the concave surfaces.

FIG. 2 shows schematically the ink splitting at the metering element 20. Concave surfaces 22 and 24 meet at front edge 36, which may be flat at the very end, for example 0.010 inches ('025 centimeter) thick. Ink film 13 is split at edge 36 so that part passes between the surface 16 and surface 22.

A generally linear velocity profile, indicated by V, thus can result, so that the velocity at the stationary surface 22 is zero, and the velocity at moving surface 16 is the surface speed of the roller 14. When the ink film exits metering element 20, the velocity profile across the entire ink film becomes more unifomm, and approximately the surface speed of the roller 14. Thus in theory the thickness of the ink film downstream from the metering element 20 reduces to half the distance D. However, based on other factors such as edge pressure, air resistance and gravity, the thickness of the fluid film downstream of the concave surface may vary from half. Half as defined herein thus includes these minor variations from a true half.

The linear velocity profile V thus can aid in setting the film thickness, as the relationship to D when the film exits is fairly constant.

Metering element 20 may be made for example of stainless steel and is preferably rigid. The surface speed of the roller 14 may be the same as that of the printing press, i.e. the surface speed of the plate or image cylinder 32, for example, surface speeds of 800 feet (244 meters) per minute or more.

A plurality of metering elements, for example ink keys, may be provided axially along roller 14.

What is claimed is:

1. A fluid delivery device for a printing machine comprising:

a rotating roller having a roller surface with a roller radius of curvature, the roller surface carrying a fluid film; and a metering element having an edge for splitting the fluid film and a first concave surface facing the roller surface;

the metering element being movable with respect to the roller surface so that the edge moves along a radial line from a center of the rotating roller.

2. The device as recited in claim 1 wherein the metering element has a second concave surface opposite the first concave surface.

3. The device as recited in claim 1 wherein the first concave surface has a radius of curvature similar to that of the roller radius of curvature.

4. The device as recited in claim 1 wherein the first concave surface corresponds to an arc of 10 degrees or more of the roller surface.

5. The device as recited in claim 1 wherein the metering element is rigid.

6. The device as recited in claim 1 wherein the metering element has a horizontal bottom surface.

7. The device as recited in claim 1 wherein the fluid is ink.

8. The device as recited in claim 1 wherein a thickness of the fluid film downstream from the metering element is half of an average distance of the concave surface from the roller surface.

9. The fluid delivery device as recited in claim 1 further comprising a reducer roll interacting with the rotating roller.

10. The fluid delivery device as recited in claim 1 further comprising a fluid supply container, the roller surface contacting the fluid supply container and the fluid film before splitting exiting the supply container.

11. A method for metering fluid in a printing press having an operating speed comprising the steps of:

supplying fluid to a supply container;

rotating a roller so as to form a film of the fluid on a surface of the roller; and splitting the film using a metering element, the metering element having a concave surface facing the surface of the roller;

wherein metering element has an edge movable solely in a radial direction with respect to the roller.

12. The method as recited in claim 11 further comprising setting a distance between the concave surface and the surface of the roller.

13. The method as recited in claim 11 wherein the first concave surface has a radius of curvature similar to that of the roller radius of curvature.

14. A fluid delivery device for a printing machine comprising:

rotating roller having a roller surface with a roller radius of curvature, the roller surface carrying a fluid film; and a metering element having an edge for splitting the fluid film and a first concave surface facing the roller surface;

the metering element being movable with respect to the roller surface;

wherein the metering element has a second concave surface opposite the first concave surface.

15. The device as recited in claim 14 wherein the metering element has an edge movable radially along a line from a radial center of the roller.

* * * * *